US010184664B2

(12) United States Patent
Chen et al.

(10) Patent No.: US 10,184,664 B2
(45) Date of Patent: Jan. 22, 2019

(54) FUEL INJECTOR FOR HIGH FLAME SPEED FUEL COMBUSTION

(71) Applicant: Capstone Turbine Corporation, Chatsworth, CA (US)

(72) Inventors: Junhua Chen, Irvine, CA (US); Mark Mitchell, Arcadia, CA (US); John Nourse, Chatsworth, CA (US); Robert D. McKeirnan, Jr., Westlake Village, CA (US)

(73) Assignee: Capstone Turbine Corporation, Chatsworth, CA (US)

( * ) Notice: Subject to any disclaimer, the term of this patent is extended or adjusted under 35 U.S.C. 154(b) by 1063 days.

(21) Appl. No.: 14/449,650

(22) Filed: Aug. 1, 2014

(65) Prior Publication Data

US 2016/0033135 A1 Feb. 4, 2016

(51) Int. Cl.

| | |
|---|---|
| ***F23R 3/28*** | (2006.01) |
| ***F23R 3/30*** | (2006.01) |
| ***F23R 3/14*** | (2006.01) |
| ***F23R 3/20*** | (2006.01) |
| ***F23D 11/40*** | (2006.01) |
| ***F23D 11/10*** | (2006.01) |
| ***F23R 3/32*** | (2006.01) |

(52) U.S. Cl.
CPC ..... *F23R 3/286* (2013.01); *F23D 11/40* (2013.01); *F23R 3/32* (2013.01)

(58) Field of Classification Search
CPC .... F23R 3/286; F23R 3/32; F23R 3/30; F23R 3/14; F23R 3/20; F23D 11/40; F23D 11/103
See application file for complete search history.

(56) References Cited

U.S. PATENT DOCUMENTS 1,826,776 A * 10/1931 Gunther ..... F23D 11/103 239/11
2,621,477 A 12/1952 Powter et al.
2,907,171 A 10/1959 Lysholm
(Continued)

FOREIGN PATENT DOCUMENTS

| | | |
|---|---|---|
| DE | 10164097 A1 | 7/2003 |
| EP | 0671590 A1 | 9/1995 |
| GB | 2073399 A | 10/1981 |

OTHER PUBLICATIONS

International Search Report in corresponding International Patent Application No. PCT/US2015/029086, dated Jul. 13, 2015, 7 pp. (not prior art).

(Continued)

*Primary Examiner* — Phuttiwat Wongwian
*Assistant Examiner* — Jessica Kebea
(74) *Attorney, Agent, or Firm* — Lucian Wayne Beavers; Patterson Intellectual Property Law, PC

(57) ABSTRACT

A multiple fuel capable, pre-mixed, low emission injector is provided which is particularly suited for burning high flame speed fuels. The fuel injector includes an injector body having a preliminary pre-mixing chamber, an intermediate pre-mixing chamber and a final pre-mixing chamber. A fuel distributor separates the preliminary pre-mixing chamber from the intermediate pre-mixing chamber. A guide vane separates the intermediate pre-mixing chamber from the final pre-mixing chamber.

15 Claims, 8 Drawing Sheets

(56) References Cited

U.S. PATENT DOCUMENTS 3,070,317 A * 12/1962 Hunter ..... F23D 11/24 239/402
3,527,052 A 9/1970 Bryce
3,739,989 A * 6/1973 Vosper ..... F23D 11/10 239/399
4,463,568 A 8/1984 Willis et al.
5,062,792 A 11/1991 Maghon
5,156,542 A * 10/1992 Hannen ..... B65B 53/06 431/114
5,359,847 A 11/1994 Pillsbury et al.
5,404,711 A * 4/1995 Rajput ..... F23D 14/02 239/400
5,408,825 A 4/1995 Foss et al.
5,592,819 A 1/1997 Ansart et al.
5,816,049 A 10/1998 Joshi
5,850,732 A * 12/1998 Willis ..... F23R 3/02 60/756
5,894,720 A * 4/1999 Willis ..... F23R 3/02 60/740
5,966,926 A 10/1999 Shekleton et al.
6,016,658 A 1/2000 Willis et al.
6,174,160 B1 1/2001 Lee et al.
6,178,751 B1 1/2001 Shekleton et al.
6,350,116 B1 2/2002 Herrmann
6,405,522 B1 6/2002 Pont et al.
6,675,583 B2 1/2004 Willis et al.
6,804,946 B2 10/2004 Willis et al.
7,090,205 B2 8/2006 Oda et al.
7,762,058 B2 7/2010 Pederson et al.
8,215,950 B2 7/2012 Singh et al.
8,413,446 B2 4/2013 Callas et al.
8,464,537 B2 6/2013 Khan et al.
2005/0044854 A1 3/2005 Cazalens et al.
2005/0198966 A1 9/2005 Boardman
2006/0107667 A1* 5/2006 Haynes ..... F23R 3/286 60/776
2007/0003897 A1* 1/2007 Koizumi ..... F23R 3/28 431/354
2010/0136496 A1* 6/2010 Kashihara ..... F23R 3/343 431/285
2012/0240586 A1 9/2012 Singh et al.
2013/0036739 A1 2/2013 Horikawa et al.
2013/0306181 A1 11/2013 Mitchell et al.
2014/0007581 A1* 1/2014 Tuthill ..... F23R 3/286 60/772
2014/0165578 A1* 6/2014 Burd ..... F02G 3/00 60/772

OTHER PUBLICATIONS

International Preliminary Report on Patentability in corresponding International Patent Application No. PCT/US2015/029086, dated Feb. 7, 2017, 11 pp. (not prior art).

International Search Report and Written Opinion in corresponding International Patent Application No. PCT/US2015/029086, dated Oct. 23, 2015, 16 pp. (not prior art).

* cited by examiner

FUEL INJECTOR FOR HIGH FLAME SPEED FUEL COMBUSTION

GOVERNMENT LICENSE RIGHTS

This invention was made with government support under Contract No. DE-EE0001732 awarded by the U.S. Department of Energy. The government has certain rights in the invention.

BACKGROUND OF THE INVENTION

1. Field of the Invention

The present invention relates generally to multistaged prevaporizing pre-mixing fuel injectors, and more particularly, to a fuel injector especially suitable for combustion of high flame speed fuels.

2. Description of the Prior Art

Fossil fuels have been widely used in power generation and other combustion applications. Alternatives to fossil fuels for production of power include use of renewable fuels. For example, one class of fuels is the syngas produced through gasification of feedstocks which results in fuel streams rich in hydrogen. Combustion of high-hydrogen-content fuels with low emissions poses some special challenges regarding the fuel injection and overall combustion system. To achieve low NOx emissions in the modern advanced combustion systems, the popular technique is burning the fuel in a lean pre-mixed manner, both for liquid and gaseous fuels. A high degree of pre-mixing of the fuel and air prior to combustion can lead to significant challenges when working with high hydrogen fuels, which may include autoignition, stability and flashback issues. Of these key operability issues, the most critical issue in this situation is flashback. The biomass gasification system output is nominally 50%-vol hydrogen/50%-vol carbon monoxide. The laminar flame speed and the reactivity of this fuel composition is much higher than that of natural gas indicating that this fuel will have a higher flashback propensity. As a result, the capability of burning highly reactive fuels (such as high-hydrogen-content syngas) in a lean, fully pre-mixed mode is a main focus of the gas turbine industry.

Other researchers have operated gas turbines on high hydrogen content fuels. Most of these previous works have focused on non-pre-mixed combustion systems. Some work with regard to the operation of pre-mixed systems on high hydrogen content fuels has also been carried out. General Electric and Siemens researchers have also investigated pre-mixed combustion systems for operation of gas turbines on high hydrogen content fuels. In general it is recognized that there are a few flashback mechanisms in a pre-mixed combustion system, namely, (1) core flashback; (2) boundary layer flashback; (3) flashback caused by combustion induced vortex breakdown dynamics and (4) flashback caused by combustion instabilities.

SUMMARY OF THE INVENTION

The design of flash-resistant pre-mixed injectors for high-hydrogen-content fuels is strongly dependent on limiting flashback possibilities along the boundary layers or near-wall layers, higher core flow velocities and elimination of recirculating flow inside the injectors, which are the fuel/air pre-mixers. As used herein, the term "near-wall layer" refers to a layer of air or other gas flowing adjacent to a wall. The "near-wall layer" will include the layer generally referred to in fluid dynamics as the boundary layer, but the "near-wall layer" may extend beyond the true boundary layer.

In one embodiment a fuel injector apparatus includes an elongated tubular injector body having an inlet end and an outlet end. The body has an inner wall defining an interior. The inner wall has one or more near-wall layer air injection ports defined therein. The fuel injector apparatus also includes a guide vane separating a final mixing chamber adjacent the outlet end from one or more pre-mixing chambers upstream of the guide vane. The guide vane includes a non-perforated lateral vane portion attached to the inner wall upstream of the one or more near-wall layer air injection ports and extending laterally inward. The guide vane also includes an axial vane portion extending downstream from the lateral vane portion and defining an axially central flow passage for all fuel-air mixture from the one or more pre-mixing chambers, the axial vane portion and the inner wall defining an injection annulus downstream of the lateral vane portion, the one or more near-wall layer air injection ports opening into the injection annulus.

In another embodiment a fuel injector apparatus includes an elongated tubular injector body having an inlet end and an outlet end. The body has an inner wall defining an interior. A fuel distributor is located in the interior and configured such that a preliminary pre-mixing chamber is defined between the inlet end and the fuel distributor. An intermediate pre-mixing chamber is defined downstream of the fuel distributor. The fuel distributor includes an axially central distributor outlet spaced from the inner wall and configured to initiate an axially central core flow stream of fuel and air mixture separated from the inner wall. A guide vane is located in the interior downstream of the fuel distributor and separates the intermediate pre-mixing chamber from a final pre-mixing chamber. The guide vane includes an axially central guide tube spaced from the inner wall and configured to maintain the axially central core flow stream of fuel and air mixture and to separate the core flow stream from an annular near-wall layer air stream concentrically surrounding the core flow stream. The near-wall layer air stream is sufficiently free of fuel such that near-wall layer flashback is inhibited.

In another embodiment a method of injecting fuel and non-fuel mixture into a gas turbine comprises:

(a) pre-mixing fuel and a non-fuel gas in one or more pre-mixing chambers of a fuel injector;

(b) guiding all of the fuel and non-fuel gas mixture from the one or more pre-mixing chambers into an axially central fuel and non-fuel gas mixture flow stream separated from an inner wall of the fuel injector by an injection annulus;

(c) injecting boundary layer non-fuel gas into the injection annulus surrounding the axially central fuel and non-fuel gas flow stream; and (d) guiding the near-wall layer non-fuel gas downstream in an annular near-wall layer non-fuel gas stream adjacent the inner wall of the fuel injector.

In another embodiment a fuel injector apparatus includes a preliminary pre-mixing chamber having an injector inlet end, an intermediate pre-mixing chamber having an intermediate pre-mixing chamber inner wall, and a final pre-mixing chamber having a final pre-mixing chamber inner wall and having an outlet end. A fuel distributor separates the preliminary pre-mixing chamber and the intermediate pre-mixing chamber, the fuel distributor including an axially projecting distributor portion projecting into the intermediate pre-mixing chamber and spaced from the intermediate pre-mixing chamber inner wall. The axially projecting distributor portion includes an axially end wall having a plurality of distributor openings such that a fuel and air mixture passes from the preliminary pre-mixing chamber into the intermediate pre-mixing chamber in an axial flow core stream. An annular near-wall layer guide vane separates the intermediate pre-mixing chamber from the final pre-mixing chamber. The guide vane includes an axially projecting guide vane portion projecting into the final pre-mixing chamber. The axially projecting guide vane portion has an open downstream end such that the axial core flow stream from the distributor passes through the guide vane. The axially projecting guide vane portion and the final pre-mixing chamber inner wall define an annulus. The final pre-mixing chamber includes a near-wall layer air inlet communicated with the annulus such that air introduced into the annulus via the near-wall layer air inlet flows to the outlet end in a near-wall layer along the final pre-mixing chamber inner wall.

In any of the above embodiments the guide vane may be configured such that fuel and air mixture exits the injector outlet in an axially central core flow stream surrounded by an annular near-wall layer flow stream relatively free of fuel so that near-wall layer flashback is inhibited.

In any of the above embodiments a fuel distributor may be disposed in the interior upstream of the guide vane. The fuel distributor includes a lateral distributor portion attached to the inner wall and extending laterally inward, and an axially projecting distributor portion projecting downstream from the lateral distributor portion. A distributor end wall having a plurality of distribution openings is located at the end of the axially projecting distributor portion. Fuel and air mixture exits the distributor end wall through the distribution openings in an axially central core flow stream aligned with the axially central flow passage of the guide vane.

In any of the above embodiments the distributor end wall may be tapered in the downstream direction to a central tip. Alternatively the distributor end wall may be flat or have other configurations.

In any of the above embodiments the inner wall of the injector body may have one or more intermediate mix air injection ports defined therein between the fuel distributor and the guide vane, for providing additional mix air to the fuel and air mixture exiting the distributor end wall, and for establishing an initial near-wall layer air flow along an inside of the axial vane portion of the guide vane.

In any of the above embodiments the one or more pre-mixing chambers may include a preliminary pre-mixing chamber between the inlet and the fuel distributor, and an intermediate pre-mixing chamber between the fuel distributor and the guide vane.

In any of the above embodiments the one or more pre-mixing chambers may include a primary pre-mixing chamber adjacent the inlet end of the injector body, and the inner wall may have one or more primary air injection ports defined therein and communicated with the primary pre-mixing chamber.

In any of the above embodiments one or more gaseous fuel inlets may be communicated with the primary pre-mixing chamber.

In any of the above embodiments one or more liquid fuel nozzles may be communicated with the primary pre-mixing chamber.

In any of the above embodiments both gaseous and liquid fuel inlets may be provided for simultaneously burning both gaseous and liquid fuel.

In any of the above embodiments the axial vane portion may terminate in a sharp edged guide vane outlet configured to atomize any remaining liquid fuel droplets.

In any of the above embodiments the outlet end of the injector body may converge to a reduced diameter outlet opening. Alternatively the outlet end of the injector body may be venturi shaped or may be diverging.

In any of the above embodiments an annular outer wall may be concentrically disposed about the injector body and define an annular air supply passage between the outer wall and the injector body, the one or more near-wall layer injection ports being communicated with the annular air supply passage.

In any of the above embodiments the annular near-wall layer air stream may be maintained sufficiently free of fuel so as to prevent near-wall layer flashback.

In any of the above embodiments the flow speed of the axially central fuel and air mixture flow stream may be maintained sufficiently high so as to prevent core flashback.

Numerous objects, features and advantages of the present invention will be readily apparent to those skilled in the art upon a reading of the following disclosure when taken in conjunction with the accompanying drawings.

DETAILED DESCRIPTION

Figure 1:
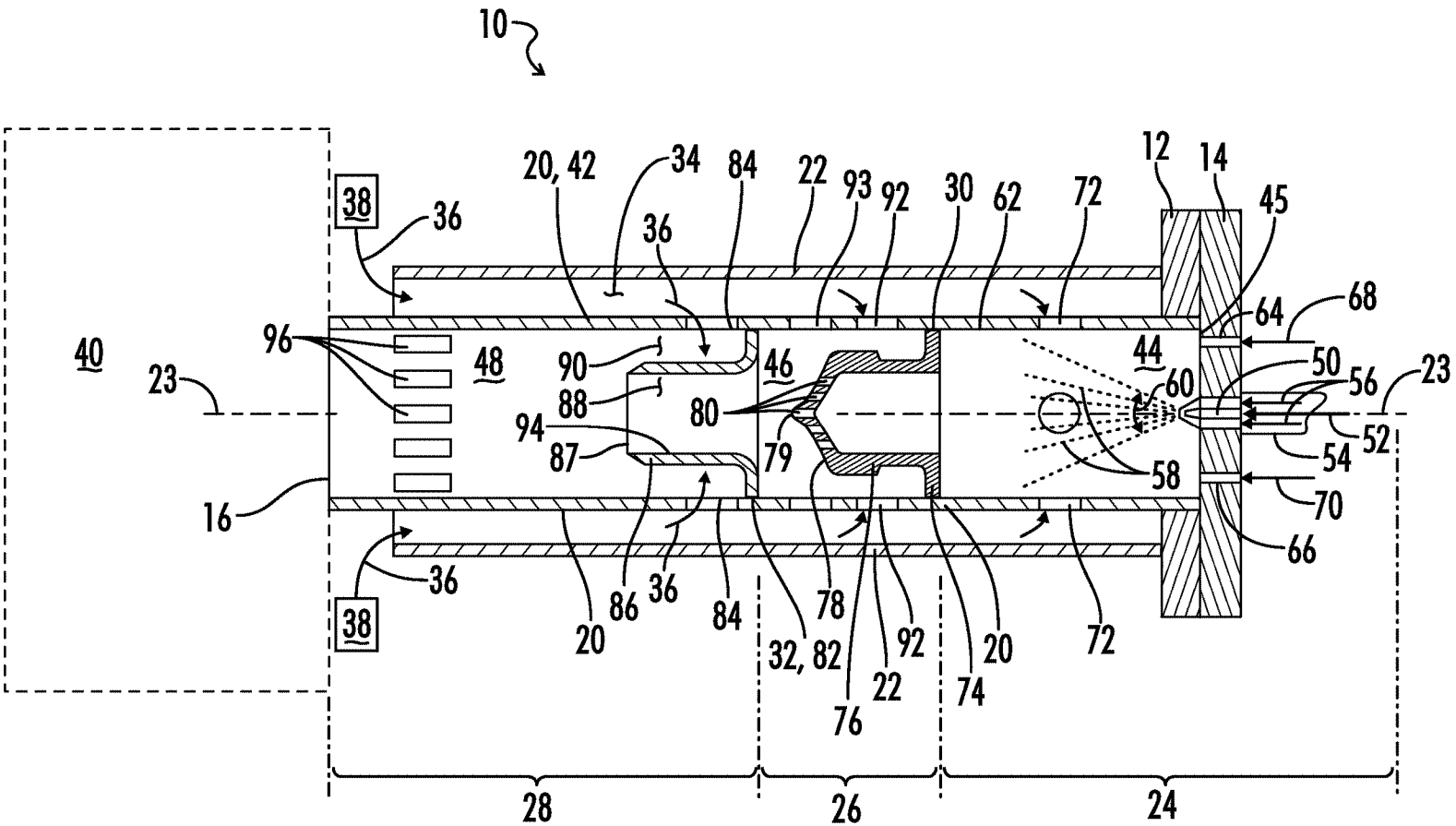
FIG. 1 is a schematic sectioned view of a fuel injector.

Referring now to FIG. 1 a fuel injector is shown and generally designated by the numeral 10. The fuel injector 10 is shown somewhat schematically in FIG. 1. Although the general geometry of the injector 10 may vary, in one embodiment the injector 10 is a modularized tubular design with mounting flanges 12 and 14 on one end, and outlet 16 on the other end. In between is the injector body which includes inner and outer concentric tubes 20 and 22. In the embodiment illustrated the fuel injector apparatus 10 has a central longitudinal axis 23.

As is further explained below with regard to the embodiment of FIG. 6, the outer tube 22 may be an angled injector mounting tube 158 extending through the annular recuperator 123 of a turbogenerator, and the flange 12 may be a mounting boss 156 located on an outer recuperator wall 157. The inner tube 20 in turn may be a fuel injector tube 161 and the flange 14 may be an angled fuel injector flange 155 complementary to the mounting boss 12, 156.

The outlet 16 may be described as a final pre-mixing chamber outlet 16.

The inner and outer tubes 20 and 22 and flanges 12 and 14 may be constructed of high temperature resistant metal, or other suitable materials.

In the embodiment illustrated in FIG. 1, the fuel injector 10 may include three stages of fuel and air prevaporizing and pre-mixing, namely a preliminary or primary prevaporizing and pre-mixing stage 24, an intermediate prevaporizing and pre-mixing stage 26, and a final prevaporizing and pre-mixing stage 28. As is further described below, in some embodiments the intermediate prevaporizing and pre-mixing stage 26 may be eliminated if sufficient prevaporization and pre-mixing is achieved in the preliminary prevaporizing and pre-mixing stage 24.

A fuel distributor 30 is shown between the preliminary and intermediate prevaporizing and pre-mixing stages. A guide vane 32 is shown between the intermediate and final prevaporizing and pre-mixing stages. If the design of the injector 10 is such that the required air and fuel mixing and flow patterns are otherwise provided, the fuel distributor 30 may be eliminated.

An annular common combustion air supply passage 34 is defined between the inner and outer tubes 20 and 22. Combustion air 36 enters the combustion air supply passage 34 from a common combustion air source 38 and is provided via the combustion air supply passage 34 to the various stages of the fuel injector 10. Alternatively, the air or other non-fuel gas 36 may be supplied from one or more other sources.

In an embodiment, the common combustion air source 38 may be a supply of preheated compressed air coming from the recuperator of a turbogenerator as is further described below with regard to FIGS. 2-6. Such preheated compressed air from the recuperator may be provided at a temperature in the range of from about 900° F. to about 1300° F. More generally the combustion air may be described as being at a temperature above about 900° F.

It will be understood that the temperature ranges described above for preheated compressed air from the recuperator are referring to the steady state temperature ranges generally achieved after the microturbine has reached its normal operating state. It will be understood that on start up of the microturbine the incoming air will be at ambient temperatures of the outside air at the location of the microturbine. Thus on start up, the compressed air exiting the recuperator may be at much lower temperatures for a short period of time until the microturbine comes up to operating temperature. Furthermore, it will be understood that for some turbine designs it is conceivable that the temperature of the preheated compressed air exiting the recuperator could exceed the 1300° F. value.

The combustion air 36 from source 38 provides both the energy for liquid fuel vaporization and the shear forces for mixing of vaporized fuel and air at the various stages of the injector 10.

It is further noted that in some embodiments the combustion air 36 may be replaced by any suitable non-fuel gas, for example oxygen, and it is not required to be "air" in the chemical sense. When various ports or passages of the fuel injector apparatus 10 are described herein as an air port or an air passage, such is intended only to be a structural description and such apparatus is not limited to use only with air.

The fuel and air mixture from the injector 10 exits via outlet 16 to a combustion chamber 40 at the desired levels of prevaporization and pre-mixing, and with a desired velocity pattern, which will depend on many factors, including but not limited to, fuel composition, operating conditions, and combustion chamber geometry among others. In an embodiment as further described with regard to FIGS. 2-6 below, the combustion chamber 40 may be an annular combustion chamber of a turbogenerator.

The inner tube 20 may be described as having an annular chamber wall 42 which defines within the tube 20 a preliminary prevaporizing pre-mixing chamber 44 associated with the preliminary prevaporizing and pre-mixing stage 24, an intermediate prevaporizing pre-mixing chamber 46 associated with the intermediate prevaporizing and pre-mixing stage 26, and a final prevaporizing pre-mixing chamber 48 associated with the final prevaporizing and pre-mixing stage 28.

It is noted that the term "annular" as used herein is not limited to a circular shape, but may include other cross-sectional shapes such as for example a square cross-section tube or any polygonal shape tube.

The preliminary prevaporizing and pre-mixing stage 24 of fuel injector 10 includes a liquid fuel atomization nozzle 50 projecting into an inlet end 45 of preliminary prevaporizing pre-mixing chamber 44. Nozzle 50 may be a pressure atomizer, an air blast nozzle, an air assist nozzle, a film atomizer nozzle, a rotary atomizer nozzle, or any other type of atomizer or nozzle with reasonable atomizing quality. It is preferred to utilize a nozzle 50 having relatively fine atomization characteristics. The example of nozzle 50 illustrated in FIG. 1 is an air-assist/air-blast liquid atomizer 50. A liquid fuel supply conduit 52 supplies liquid fuel to nozzle 50. The liquid fuel may for example be number 2 diesel fuel. A concentric atomization air supply tube 54 concentrically disposed about liquid fuel supply conduit 52 provides atomization air 56 to nozzle 50. The shear forces between the atomization air 56 and liquid fuel will cause the fuel to break up to form liquid fuel droplets 58 projected from nozzle 50 into the preliminary prevaporizing pre-mixing chamber 44 generally co-axial with the longitudinal axis 23 and in a direction toward the final prevaporizing pre-mixing chamber 48. It is also noted that the atomization assist gas for the liquid fuel nozzle 50 can either be air or a gaseous fuel. Particularly, a low quality gaseous fuel may be advantageously utilized as atomization assist gas to the liquid fuel nozzle 50.

The design of the nozzle 50 is preferably selected such that a spray angle 60 of the spray of liquid fuel droplets 58 is such that a minimal number of liquid fuel droplets hit the hot inner wall surface 62 of chamber wall 42 of preliminary prevaporizing pre-mixing chamber 44 in order to avoid coking of the liquid fuel on the chamber wall 42.

It is noted that although the fuel injection nozzle 50 is shown as a single liquid fuel inlet located axially within the fuel injector, it is within the broader scope of the present disclosure to utilize multiple liquid fuel inlets which need not be axially located.

The fuel injector apparatus 10 is designed to provide the capability of handling liquid fuel via nozzle 50 and also one or more sources of gaseous fuel, either alternatively or simultaneously. To that end, injector apparatus 10 includes first and second gaseous fuel inlets 64 and 66, respectively, for supplying gaseous fuels via first and second gas supply lines 68 and 70, respectively. It is noted that in some special applications the inlets 64 and 66 may be used to supply other non-fuel process gases.

In the preliminary prevaporizing and pre-mixing stage 24, high temperature combustion air 36 from air supply passage 34 flows through a plurality of openings 72 which may be referred to as preliminary air inlets 72 defined through the chamber wall 42. The combustion air 36 flowing through openings 72 flows transversely to axis 23. The combustion air flowing through preliminary air inlets 72 provides the required energy to at least partially vaporize the atomized liquid fuel droplets 58. The amount of combustion air 36 flowing through preliminary air inlets 72 is controlled by the design of the inlets 72 such that the resulting fuel and air mixture in the preliminary prevaporizing pre-mixing chamber 44 cannot autoignite. Air inlets 72 are preferably located downstream of nozzle 50. The geometry of the preliminary air inlets 72, including the total area, shape and locations of those inlets is selected to provide the desired amount of combustion air and to define the desired flow pattern within preliminary prevaporizing pre-mixing chamber 44 to vaporize the liquid fuel droplets 58 and pre-mix the vaporized fuel with the combustion air.

The fuel distributor 30 separates the preliminary pre-mixing chamber 44 and the intermediate pre-mixing chamber 46. The fuel distributor 30 includes a lateral distributor portion 74 attached to the inner wall 42. The fuel distributor 30 further includes an axially projecting distributor portion 76 projecting downstream from the lateral distributor portion 74. A distributor end wall 78 closes the axially projecting distributor portion 76 and has a plurality of distributor openings 80 therein such that fuel and air mixture passes from the preliminary pre-mixing chamber 44 through openings 80 into the intermediate pre-mixing chamber 46 in an axial core flow stream. Other patterns of openings 80 different from that shown in FIG. 1 may be selected to provide a desired fuel/air mixing level and velocity profile to provide capability to achieve low emissions, stability and flashback prevention.

Figure 9:
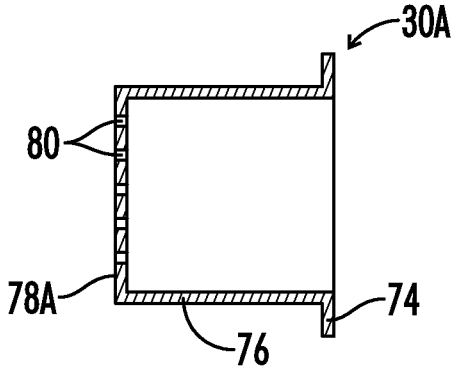
FIG. 9 is a schematic sectioned view of an alternative embodiment of the distributor.

The distributor end wall 78 may be tapered in the downstream direction to a central tip 79 as shown in FIG. 1. Alternatively, as shown in FIG. 9, the end wall 78A may be flat. Other end wall shapes such as a convex or concave end wall could also be used.

The guide vane 32 separates the intermediate pre-mixing chamber 46 from the final pre-mixing chamber 48. The guide vane 32 includes a non-perforated lateral vane portion 82 attached to the inner wall 42 upstream of one or more near-wall layer air injection ports 84. The near-wall layer air injections ports 84 extend through the inner wall 42 and communicate with the common air supply passage 34.

The guide vane 32 further includes an axial vane portion 86, which may also be referred to as an axially central guide tube 86, extending downstream from the lateral vane portion 82 and defining an axially central flow passage 88 for all fuel-air mixture from the pre-mixing chambers 44 and 46. The axial vane portion 86 and the inner wall 42 define an injection annulus 90 downstream of the lateral vane portion 82. The near-wall layer air injection ports 84 open into the injection annulus 90.

The axial vane portion 86 may terminate in a sharp edged guide vane outlet 87 configured to atomize any remaining liquid fuel droplets that pass from the intermediate pre-mixing chamber 46 into the final pre-mixing chamber 48. The axial vane portion 96 may also include perforations (not shown) communicating the annulus 90 with the central flow passage 88, so that additional mix air flows from annulus 90 into the central flow passage 88.

The inner wall 42 of the injector body 20 has one or more intermediate mix air injection ports 92 defined therein between the fuel distributor 30 and the guide vane 32, for providing additional mix air to the fuel and air mixture exiting the distributor end wall 78, and for establishing an initial near-wall layer air flow along an inside wall 94 of the axially central flow passage of the guide vane 32. At least some of the intermediate mixing air injection ports 92 are located upstream of the distributor outlet end 78 so that an intermediate chamber near-wall layer having a reduced fuel content as compared to a center of the core flow stream is established in the intermediate pre-mixing chamber 46 and in the axial vane portion 86.

Additional intermediate mixing chamber air injection ports 93 may be located downstream of the end wall 78 of distributor 30.

Thus, the pre-mixing of fuel and air begins in the preliminary prevaporizing pre-mixing chamber 44. After a residence time required for the fuel and air mixture to flow through the preliminary prevaporizing pre-mixing chamber 44, the prevaporized and pre-mixed fuel and air mixture flows through distribution holes 80 in the flow distributor 30 into the intermediate prevaporizing pre-mixing chamber 46.

It is desired that when the fuel and air mixture enters the final prevaporizing pre-mixing chamber 48, that the liquid fuel be substantially fully vaporized. To that end, if the fuel and air mixture leaving the preliminary prevaporizing pre-mixing chamber 44 is not adequately prevaporized, the intermediate prevaporizing and pre-mixing stage 26 may be provided. In the intermediate prevaporizing pre-mixing chamber 46 additional hot combustion air 36 from combustion air supply passage 34 is introduced into intermediate chamber 46 via intermediate air inlets 92 and 93 to further vaporize the liquid fuel droplets flowing through the intermediate prevaporizing pre-mixing chamber 46. Again, in the intermediate stage 26, the fuel and air mixture is controlled such that the fuel and air mixture cannot autoignite and the temperature of the mixture is controlled to avoid liquid fuel coking within intermediate chamber 46.

As the fuel and air mixture flows from the preliminary pre-mixing chamber 44 through the distributor 30, and particularly through the axial distributor portion 76 and the openings 80 of end wall 78, an axially central fuel and air mixture flow stream is initiated as the fuel and air mixture flows through the axially central outlet openings 80 of the end wall 78 of the distributor 30.

The additional air entering the intermediate chamber 46 through openings 92 and 93 begins to form an intermediate chamber near-wall layer having a reduced fuel content as compared to a center of the core flow stream that is established in the intermediate pre-mixing chamber and in the central guide tube 86 of guide vane 32.

Thus, the core flow stream is initiated by the shape of the distributor 30 and is further formed by the shape of the guide tube 86 of guide vane 32. Furthermore that axial core flow stream as it exits guide tube 86 already has a near-wall layer of reduced fuel content adjacent inner surface 94 of guide tube 86 because of the air introduced at the intermediate air inlets 92 and 93.

Additionally, further near-wall layer air is injected through openings 84 into the annulus 90 between guide tube 86 and inner wall 42 in the final pre-mixing chamber 48. It is primarily this near-wall layer stream formed by the air flowing into inlets 84 that provides the near-wall layer air flow along inner wall 42 as the mixture exits the outward end 16 of final premixing chamber 48.

It is also noted that to the extent the liquid fuel droplets have not been fully vaporized prior to entering the final prevaporizing pre-mixing chamber 48, further prevaporization of liquid fuel droplets will occur. It will be appreciated that although it is preferred that the liquid fuel droplets be substantially fully vaporized prior to entering the final prevaporizing pre-mixing chamber 48, to the extent the liquid fuel droplets are not fully prevaporized, they will be further prevaporized in the final chamber 48. Thus the final chamber 48 may be referred to either as a final prevaporizing pre-mixing chamber 48 or simply as a final pre-mixing chamber 48, and in either event it is understood that some additional prevaporizing of fuel may occur in the final chamber 48.

Additionally, and optionally, additional combustion air 36 may enter the final chamber 48 through a plurality of swirling slots 96 defined through the chamber wall 42. The size, location and geometry of the near-wall layer air inlets 84 and/or the swirling slots 96 is selected depending upon the desired flow pattern and fuel and air mixing levels, and also dependent upon the geometry of the downstream combustion chamber 40.

The fuel distributor 30 is designed to distribute fuel flow from upstream as evenly as possible to the center of the injector, but also to avoid fuel presence in the regions near the inner wall 42 of injector body 20. The end wall 78 may have the tapered streamlined shape shown and is aligned with the ports 93 so as to quickly and effectively mix the fuel coming through the distributor openings 80 with the additional air introduced through ports 93.

The axial spacing between the fuel distributor 30 and the guide vane 32 should be long enough to allow further mixing between the fuel streams exiting openings 80 with the additional air introduced at openings 92 and 93. Ideally, to reach low emissions, the fuel air mixing should reach a reasonably low fuel concentration variation, for example, smaller than 10%.

The flow guiding vane 32 serves multiple purposes. The vane 32 keeps the fuel containing air fuel mixture to the center of the injector to define the axial core flow stream. The guide vane 32 guides air from the openings 84 to attach to the inner wall 42 and form what may be called the second near-wall layer air. The guide vane 32 performs a secondary atomization (film atomization) along its inner surface 94 to atomize any residual fuel droplets when used in liquid fuel applications. The guide vane 32 controls flow mixing characteristics by varying its length. The guide vane 32 speeds up flow at the exit of the intermediate stage 46 due to the reduced cross-sectional area of axial vane portion 86 to avoid flashback in the core flow stream.

For liquid fuel applications it is highly desired that the liquid fuel droplets be fully vaporized before entering the last mixing chamber 48. In the last stage chamber 48 further fuel air mixing and flow conditioning takes place either with or without the swirling slots 96. In this last stage 48 further flow development and fuel mixing take place such that a desired fuel-to-air ratio distribution and velocity profile will be achieved at the exit 16 of the injector 10.

The geometry of the various air inlet openings 72, 92, 93, 84 and 96 determines the amount of air that passes into the injector 10 from common supply passage 34 and impacts directly on the mixing and flow characteristics of the fuel and air mixture at the exit 16 of the injector.

The design of the injector 10 is preferably configured to achieve the following flow characteristics at the injector exit:

(1) A layer of air without any fuel in the area adjacent the inner wall 42 of the injector 10 such that near-wall layer flashback mechanism can be prevented from occurring;

(2) In the central or axial area of the injector, a fully prevaporized (for liquid fuel) and well pre-mixed fuel and air mixture is provided such that low emissions can be achieved in the subsequent combustion process; and (3) A core flow velocity is provided of sufficiently high speed such that the core flashback mechanism can be prevented from occurring.

Additional design variations that can be utilized with the injector 10 include the following:

(1) The various air holes which are shown in the drawings as being round in shape may have other shapes.

Figure 8:
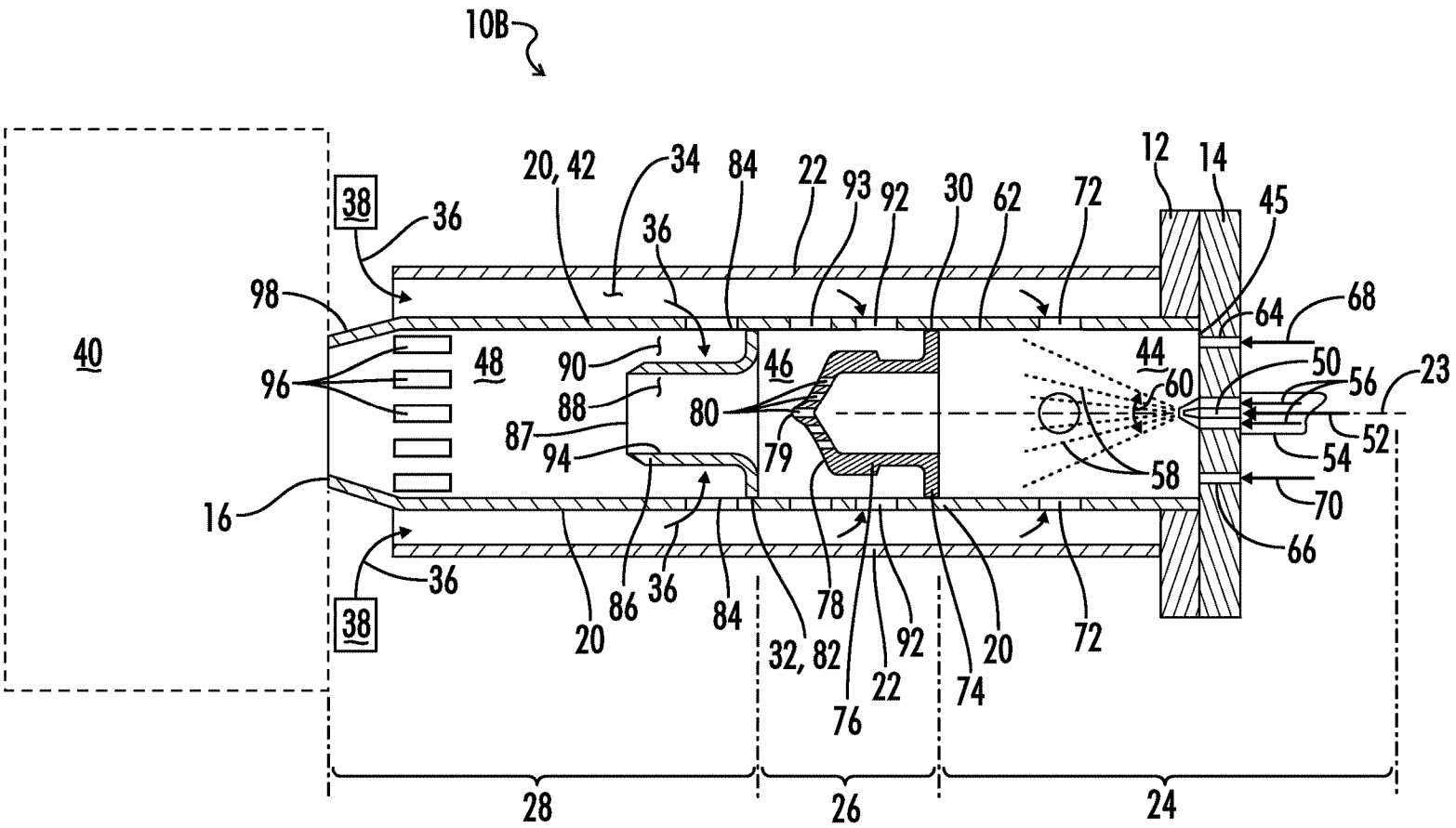
FIG. 8 is a schematic sectioned view similar to FIG. 1 and showing another alternative embodiment of the fuel injector.
Figure 10:
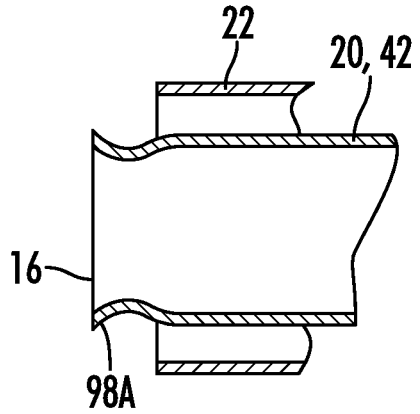
FIG. 10 is a schematic sectioned view of another alternative embodiment of the outlet end of the fuel injector having a venturi shape.
Figure 11:
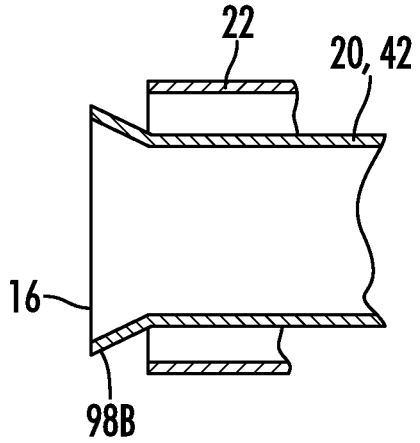
FIG. 11 is a schematic sectioned view of another alternative embodiment of the outlet end of the fuel injector having a diverging shape.

(2) Although the injector exit is shown in FIG. 1 as a straight tube, it can be of a venturi or converging shape as shown in FIG. 8, a venturi shape as shown in FIG. 10, or a diverging shape as shown in FIG. 11.

(3) Swirlers may be added to the various air inlets to generate swirling effects.

(4) Different coatings can be applied along the walls of the injector. For example a thermal barrier coating for heat prevention or a catalytic coating for changing the gas chemical characteristics may be applied.

Alternative Embodiments of FIGS. 7-11

In the various alternative embodiments shown in FIGS. 7-11, components identical or similar to components shown in FIG. 1 may be identified in the figures with the same numerals used in FIG. 1. Components which are analogous but significantly modified may be designated by the addition of a suffix such as "A" or "B" to note a modification as compared to FIG. 1.

Figure 7:
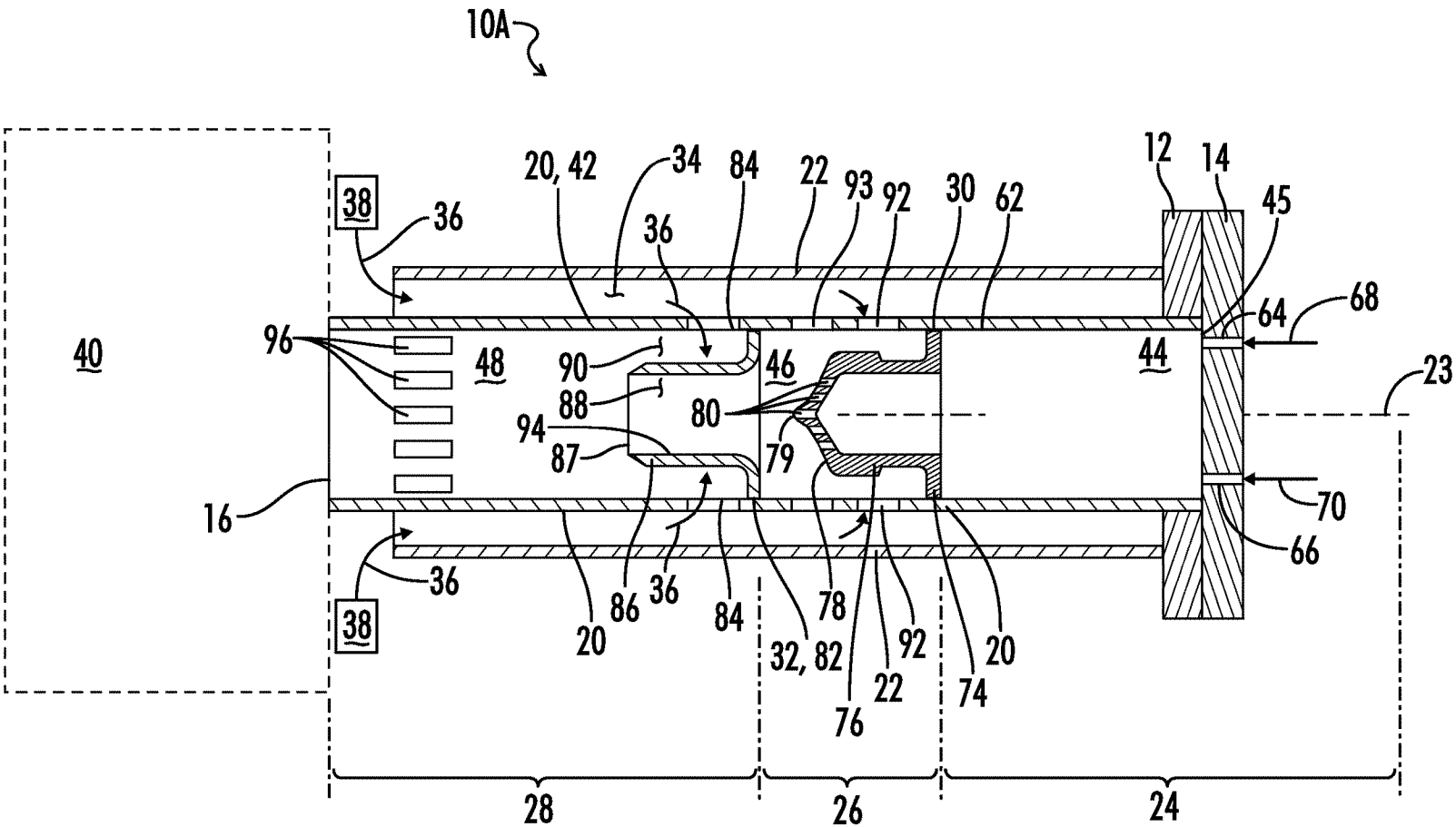
FIG. 7 is a schematic sectioned view similar to FIG. 1 and showing an alternative embodiment of the fuel injector.

In the embodiment of FIG. 7, the liquid fuel injection nozzle 50 has been deleted so that the fuel injector 10A of FIG. 7 is designed for use solely with gaseous fuels introduced through gaseous fuel inlets 64 and 66.

FIG. 8 shows another alternative embodiment designated by the numeral 10B in which an outlet end portion 98 of the inner tube 20 converges toward the outlet end 16 so that the cross-sectional area of the final chamber 48 adjacent the outlet end 16 is of decreasing cross-sectional area.

FIG. 9 shows an alternative construction of the distributor, designated as 30A, in which the end wall 78A is flat rather than tapered.

FIG. 10 shows an alternative end shape for the outlet end portion of the inner tube in which the outlet end is venturi shaped. The venturi shaped end portion is designated as 98A.

FIG. 11 shows another alternative end shape for the outlet end portion of the inner tube in which the outlet end diverges. The diverging end portion is designated as 98B.

Multi-Fuel Capabilities and the Ability to Utilize High Flame Seed Fuels

The fuel injectors 10, 10A and 10B of FIGS. 1, 7 and 8 are particularly well adapted for burning high flame speed/high reactivity fuels. The high flame speed fuels can be in either liquid or gaseous states. For gaseous fuels, the high flame speed fuels may typically have high hydrogen ($H_2$) content. The design aims to burn high flame speed/high reactivity fuels while maintaining good stability and performance, including ultra-low emissions.

In addition to the combustion air mixed with the fuel in the axially center portion of the injector, an optimal amount of air is introduced as "near-wall layer air" to flow along the injector walls, which reduces or completely eliminates fuel presence along the near-wall layers of the injector such that near-wall layer flashback can be avoided.

The injector generally may include the following features:

(1) The gaseous fuel inlets, which can either be the liquid fuel inlet 50 or a plurality of inlets 50, 64, 66 for combinations of different types of fuel;

(2) The fuel distributor 30, which is designed to distribute fuel and promote mixing with combustion air without causing flow recirculation;

(3) Combustion (mixing) air ports 72, 92, 93 to introduce air to fully mix with the fuel streams to achieve ultra-low emissions;

(4) The near-wall layer air guiding vane 32 which forces air to flow along the inner wall 42 and prevents fuel from flowing into the near-wall layer along the inner wall 42;

(5) The near-wall layer air ports 92 through which air is introduced to flow along the inside wall 94 of the guiding vane 86 to reduce fuel presence;

(6) The near-wall layer ports 84 which introduce near-wall layer air to flow along the injector wall 42 in the final chamber 48 to prevent fuel from entering that near-wall layer so as to avoid flashback by increased near-wall layer flow speed and by preventing fuel presence in the near-wall layer;

(7) The preliminary pre-mixing/prevaporizing chamber 44 for pre-mixing fuel and air, and in the case of liquid fuel to prevaporize fuel droplets; and (8) The final pre-mixing/prevaporizing chamber 48, which provides space and residence time for the further mixing of fuel and air, and prevaporization for liquid fuel droplets before forming the desired fuel and air flow distribution at the injector exit 16.

The design is capable of combusting both gaseous and liquid fuels. The design aims to improve combustion performance by improving:

(1) Flashback margin for burning high flame speed fuels, either gaseous or liquid fuel;

(2) Gaseous/liquid fuel pre-mix atomization and pre-mixing quality;

(3) Flame stability;

(4) Multi-fuel capability which means using one or more fuels independently;

(5) The ability to switch between different fuels including but not limited to while the system is operating;

(6) Simultaneously using more than one fuel or input stream of fuel;

(7) The ability to extend fuel flexibility, that is to broaden the range of fuels or input streams that may be consumed;

(8) The method by which multiple inputs or fuel streams can be mixed and consumed within the gas turbine avoiding external mixing methods;

(9) The method by which one input fuel stream properties or attributes can be enhanced by mixing with another stream;

(10) The method of multi-stage fuel preparation in a compact form;

(11) The method by which one input stream may be destroyed using another;

(12) The method by which to use fuel or input streams of different phases such as a liquid and a gaseous input stream; and

(13) A method by which to burn liquid or gaseous stream with suspended solids.

The design of the fuel injector 10 can potentially solve flashback problems when burning high flame speed fuels. Other advantages of the design may include:

(1) Multi-fuel capability of the injector;

(2) Improved liquid fuel pre-mixing, prevaporization quality;

(3) Reduced liquid fuel tube coking;

(4) Lower NOx emissions;

(5) Lower CO emissions;

(6) Lower THC or VOC emissions;

(7) Lower particulate emissions;

(8) Improved power by improving combustor exit temperature pattern and profile;

(9) Improved efficiency by improving combustor exit temperature pattern and profile;

(10) Utilizing low quality fuel which would otherwise go unused;

(11) Utilizing low quality fuel not easily used by other turbines or types of turbines;

(12) Improving emissions especially, including under difficult cold start situations;

(13) Avoiding multi-stream mixing problems;

(14) Improving tolerance to fuel contamination such as the passage of solids;

(15) Extending the range of low BTU gases;

(16) The design can burn MBTU or LBTU gases as digesters or landfills age without requiring a replacement of injector types;

(17) The ability to burn fuels which are normally hard to keep in one phase, including propane, butane, naphtha, kerosene, DME, ethanol and other bio-derived fuels;

(18) Improved combustion stability range;

(19) Improved flashback margin and prevention;

(20) Improved tolerance to acoustic interaction;

(21) Improved injector life and durability;

(22) The design allows the use of lower cost injector materials instead of high temperature alloys;

(23) Due to its fuel flexibility, the design allows a lower part count across product lines and improves inventory management and inventory turns;

(24) The design simplifies injector manufacturing processes;

(25) The design simplifies and improves field service ability because normal replacement items may not require the injector to be removed to be serviced or may prevent the entire injector from being replaced;

(26) The design improves the ability to refurbish and remanufacture returned injectors;

(27) The modular design allows for easy customization if necessary;

(28) The modular design allows some common components to be used across a wide range of product platforms;

(29) The design lowers non-recurring engineering costs typically associated with complex injector designs by separating necessary physical processes such as atomization and vaporization and mixing within modular injectors-components;

(30) The design avoids wall wetting at the injector exit into the combustor;

(31) The dedicated near-wall layer air streams eliminate fuel presence along the near-wall layer for flashback avoidance;

(32) The venturi type contraction inside the injector isolates flashback/flame anchoring to the injector exit only, which prevents hardware damage to components upstream of the venturi, and makes it easier to retrofit injectors if flashback ever happens;

(33) Introducing fuel in the center of the injector;

(34) Having a single or multiple pre-mixing chamber;

(35) Adding a single or multiple prevaporizing chamber; and

(36) Refining the capability to change liquid nozzles.

The injector 10 aims to deliver a fuel/air mixture to the downstream combustion chamber 40 with a desired level of fuel/air mixing, and fuel/air ratio distribution at the injector exit 16 such that stable combustion and low NOx emission is achieved without issues such as liquid fuel coking, flashback or autoignition inside the injector 10. The injector 10 is a fuel and air preparing device for low emission combustion to occur in the downstream combustion chamber 40. This fuel/air injector 10 may be used in the gas turbine shown in FIGS. 2-5 and in other types of combustion systems, for one or multiple fuel types.

Use of Fuel Injector in a Turbogenerator

Referring now to FIGS. 2-6, the general construction of a typical turbogenerator in which the fuel injector apparatus 10 may be utilized, and the manner in which the fuel injector apparatus 10 would be assembled with the turbogenerator is shown. It is noted that the alternative injectors 10A and 10B may also be used in place of injector 10.

Figure 2:
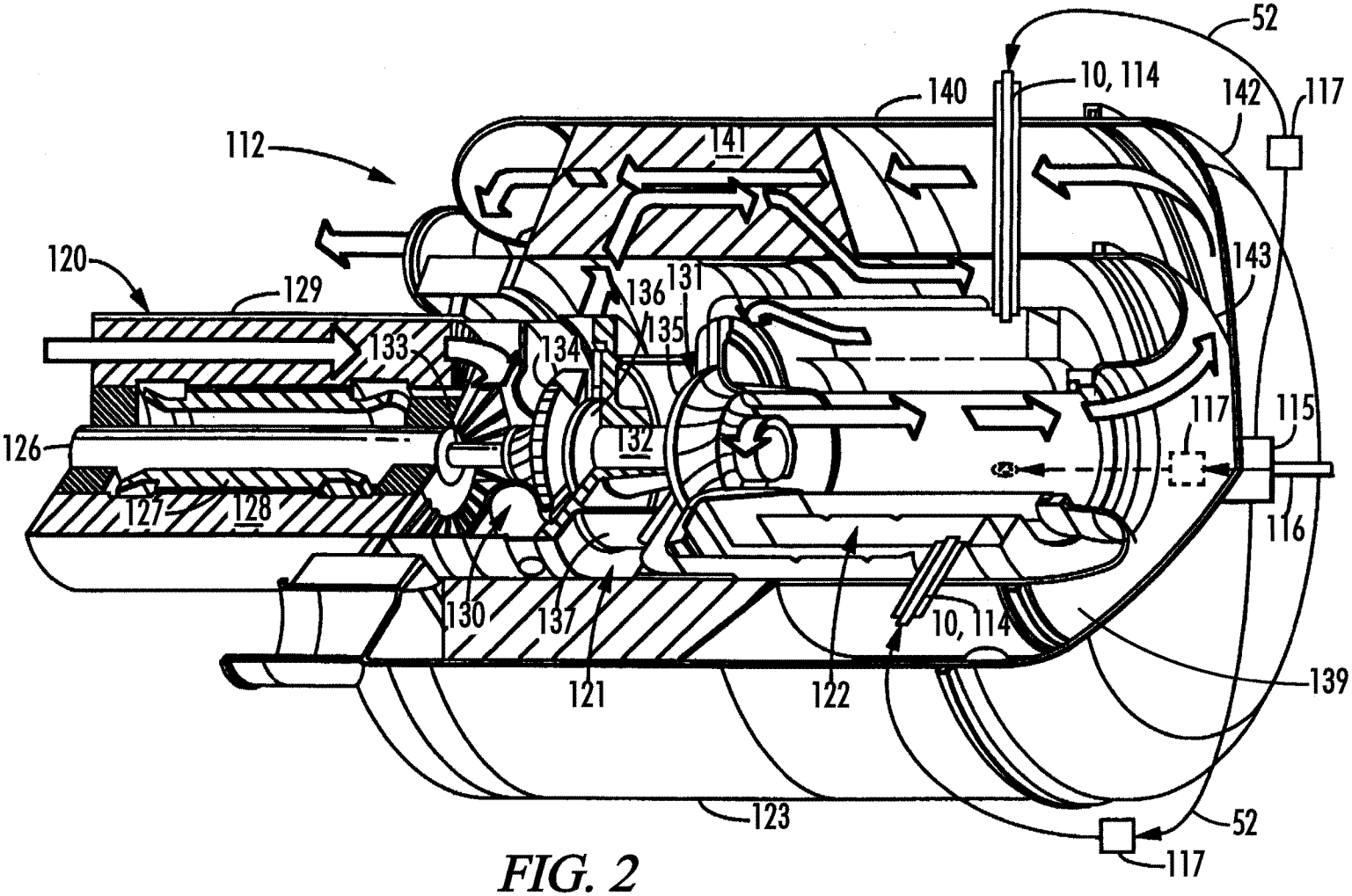
FIG. 2 is a perspective, partially cutaway view, of a turbogenerator utilizing the fuel injector of FIG. 1.

A turbogenerator 112 utilizing the fuel injector 10 and the low emissions combustion system of the present invention is illustrated in FIG. 2. The turbogenerator 112 generally comprises a permanent magnet generator 120, a power head 121, a combustor 122 and a recuperator (or heat exchanger) 123.

The permanent magnet generator 120 includes a permanent magnet rotor or sleeve 126, having a permanent magnet disposed therein, rotatably supported within a permanent magnet stator 127 by a pair of spaced journal bearings. Radial permanent magnet stator cooling fins 128 are enclosed in an outer cylindrical sleeve 129 to form an annular air flow passage which cools the permanent magnet stator 127 and thereby preheats the air passing through on its way to the power head 121.

The power head 121 of the turbogenerator 112 includes compressor 130, turbine 131, and bearing rotor 132 through which the tie rod 133 to the permanent magnet rotor 126 passes. The compressor 130, having compressor impeller or wheel 134 which receives preheated air from the annular air flow passage in cylindrical sleeve 129 around the permanent magnet stator 127, is driven by the turbine 131 having turbine wheel 135 which receives heated exhaust gases from the combustor 122 supplied with preheated air from recuperator 123. The compressor wheel 134 and turbine wheel 135 are supported on a bearing shaft or rotor 132 having a radially extending bearing rotor thrust disk 136. The bearing rotor 132 is rotatably supported by a single journal bearing within the center bearing housing 137 while the bearing rotor thrust disk 136 at the compressor end of the bearing rotor 132 is rotatably supported by a bilateral thrust bearing.

Intake air is drawn through the permanent magnet generator 120 by the compressor 130 which increases the pressure of the air and forces it into the recuperator 123. The recuperator 123 includes an annular housing 140 having a heat transfer section 141, an exhaust gas dome 142 and a combustor dome 143. Exhaust heat from the turbine 131 is used to preheat the air before it enters the combustor 122 where the preheated air is mixed with fuel and burned. The combustion gases are then expanded in the turbine 131 which drives the compressor 130 and the permanent magnet rotor 126 of the permanent magnet generator 120 which is mounted on the same shaft as the turbine 131. The expanded turbine exhaust gases are then passed through the recuperator 123 before being discharged from the turbogenerator 112.

Figure 4:
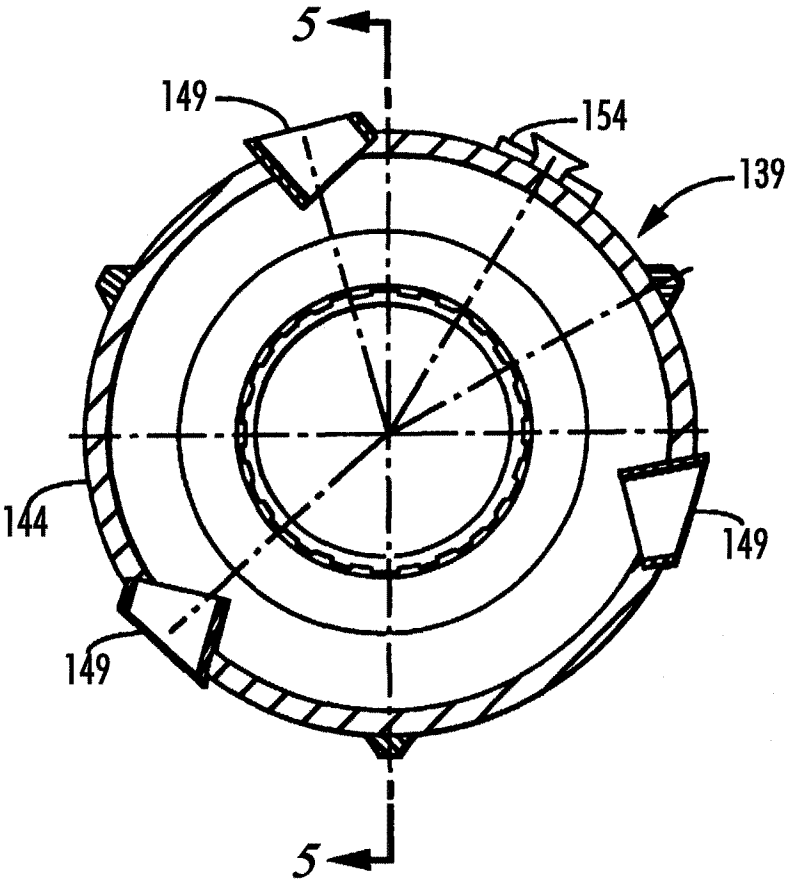
FIG. 4 is a sectional view of the combustor housing of FIG. 3 taken along line 4-4 of FIG. 3.
Figure 3:
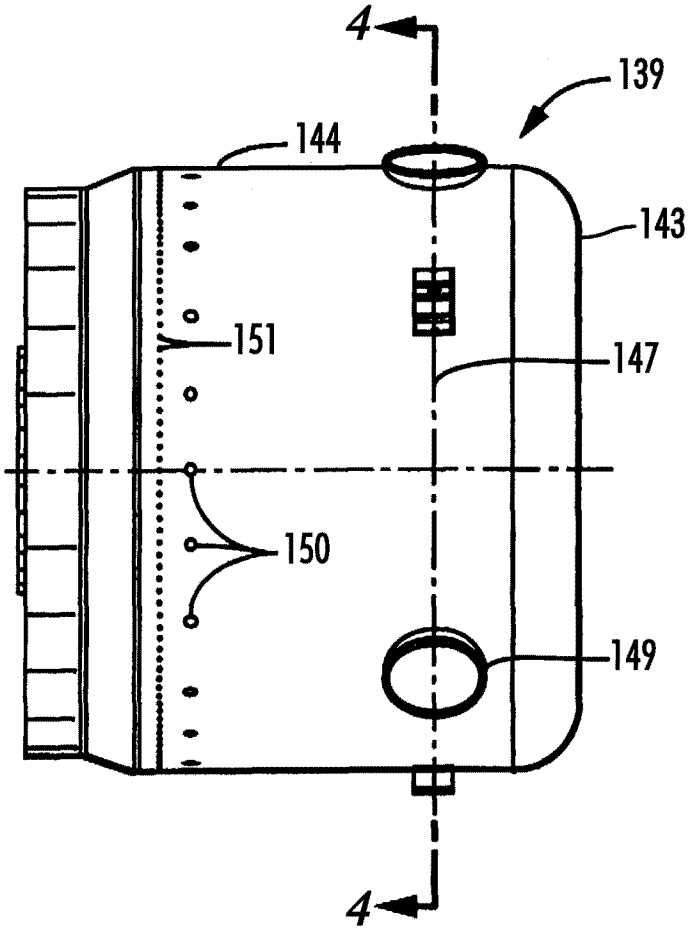
FIG. 3 is a plan view of a combustor housing for the turbogenerator of FIG. 2.
Figure 5:
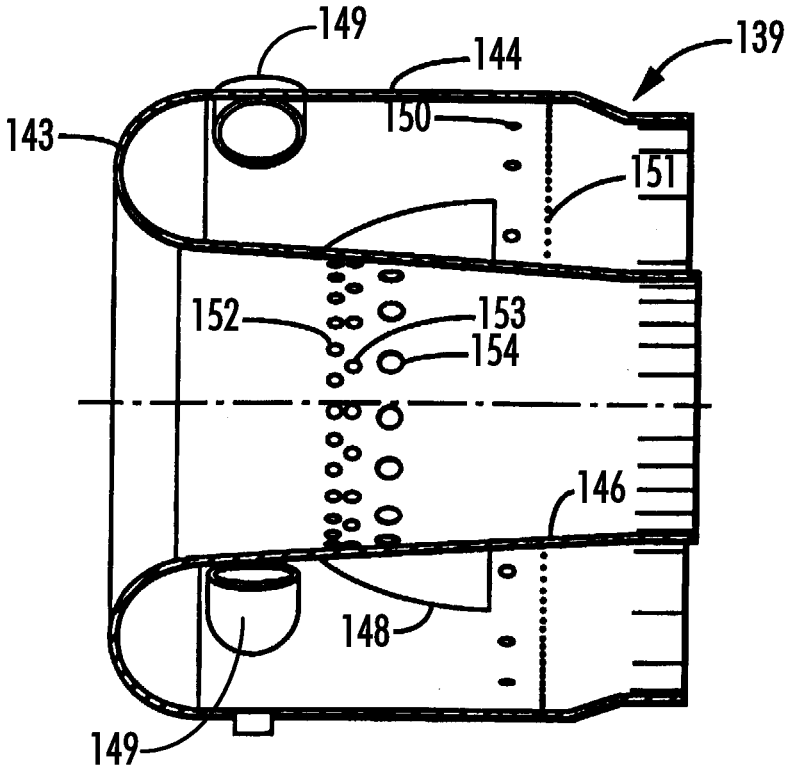
FIG. 5 is a sectional view of the combustor housing of FIG. 4 taken along line 5-5 of FIG. 4.

The combustor housing 139 of the combustor 122 is illustrated in FIGS. 3-5, and generally comprises a cylindrical outer liner 144 and a tapered inner liner 146 which, together with the combustor dome 143, form a generally expanding annular combustion housing or chamber 139 from the combustor dome 143 to the turbine 131. A plurality of fuel injector guides 149 (shown as three) position the fuel injectors 10, 114 to tangentially introduce a fuel/air mixture at the combustor dome 143 end of the annular combustion housing 139 along the fuel injector axis or centerline 147. This same centerline 147 includes an ignitor cap 154 to position an ignitor (not shown) within the combustor housing 139. The combustion dome 143 is rounded out to permit the swirl pattern from the fuel injectors 10, 114 to fully develop and also to reduce structural stress loads in the combustor. It will be understood that the fuel injectors 10, 114 are preferably constructed in a manner like that described above for fuel injector 10 of FIG. 1, or the injectors 10A or 10B shown in FIGS. 7 and 8.

A flow control baffle 148 extends from the tapered inner liner 146 into the annular combustion housing 139. The baffle 148, which would be generally skirt-shaped, would extend between one-third and one-half of the distance between the tapered inner liner 146 and the cylindrical outer liner 144. Three rows each of a plurality of spaced offset air dilution holes 152, 153, and 154 in the tapered inner liner 146 underneath the flow control baffle 148 introduce dilution air into the annular combustion housing 139. The first two (2) rows of air dilution holes 152 and 153 (closest to the fuel injector centerline 147) may be the same size with both, however, smaller than the third row of air dilution holes 154.

In addition, two (2) rows each of a plurality of spaced air dilution holes 150 and 151 in the cylindrical outer liner 144, introduce more dilution air downstream from the flow control baffle 148. The plurality of holes 150 closest to the flow control baffle 148 may be larger and less numerous than the second row of holes 151.

Liquid fuel can be provided individually to each fuel injector 10, 114, or, as shown in FIG. 2, a liquid fuel manifold 115 can be used to supply liquid fuel to all three (3) fuel injectors 10, 114. The liquid fuel manifold 115 includes a liquid fuel inlet 116 to receive fuel from a fuel source (not shown). Flow control valves 117 are provided in each of the fuel lines 52 from the manifold 115 to the fuel injectors 10, 114. In order to sustain low power operation, maintain fuel economy and low emissions, the flow control valves 117 can be individually controlled to an on/off position (to separately use any combination of fuel injectors individually) or they can be modulated together. The flow control valves 117 can be opened by fuel pressure or their operation can be controlled or augmented with a solenoid.

Figure 6:
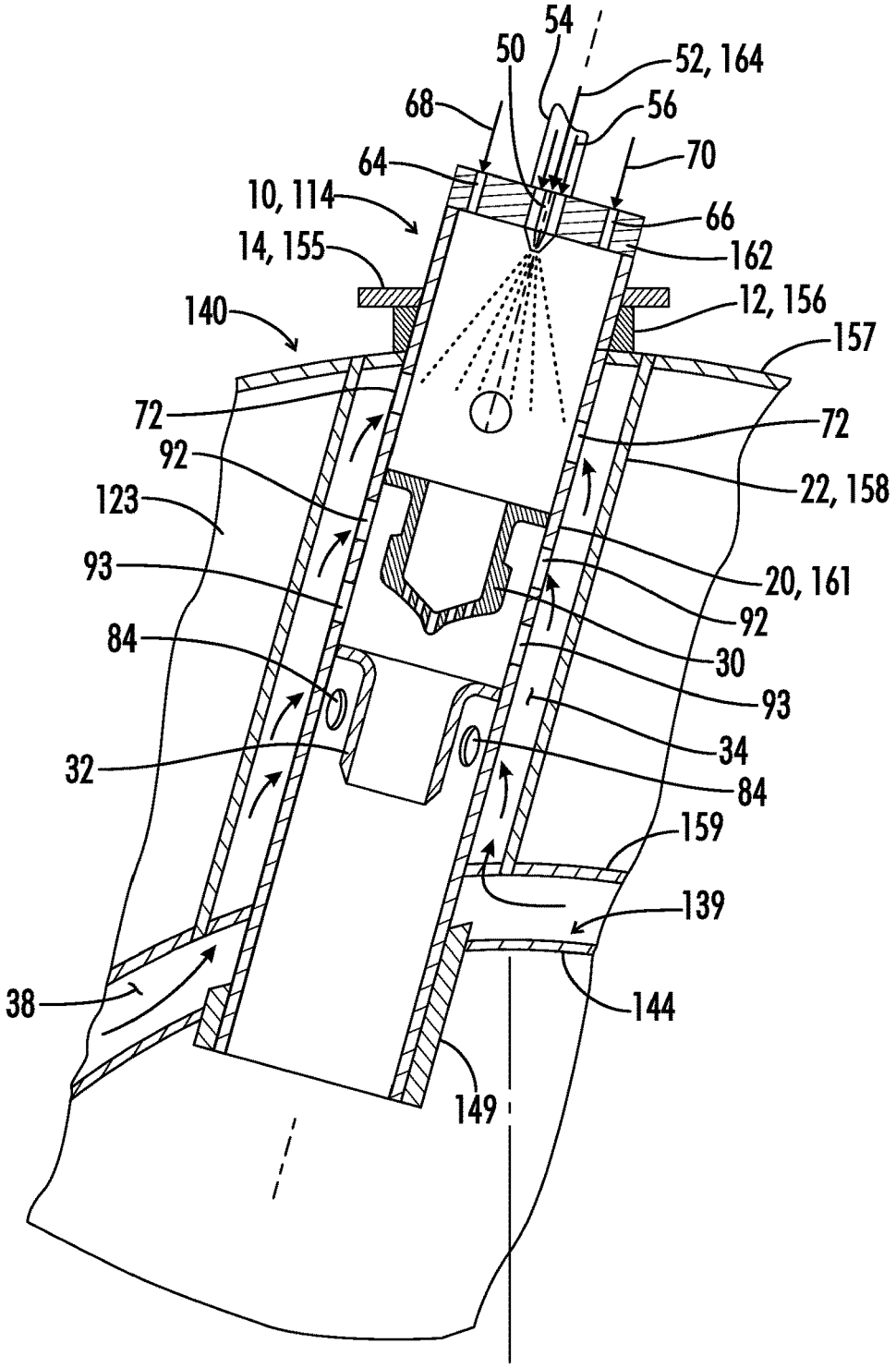
FIG. 6 is an enlarged schematic sectional view of a modified version of the fuel injector of FIG. 1 in place within the turbogenerator of FIG. 2.

FIG. 6 schematically illustrates the fuel injector 10, 114 extending through the recuperator housing 140 and into the combustor housing 139 through a fuel injector guide 149. The fuel injector flange 14, 155 is attached to the boss 12, 156 on the outer recuperator wall 157 and extends through an angled tube 22, 158 between the outer recuperator wall 157 and the inner recuperator wall 159. The fuel injector 10, 114 extends through the fuel injector guide 149 in the cylindrical outer liner 144 of the combustor housing 139 into the interior of the annular combustion housing 139.

The fuel injectors 10, 114 generally comprise an injector tube 20, 161 having an inlet end and a discharge end. The inlet end of the injector tube 20, 161 includes a coupler 162 having a fuel inlet tube 52, 164 which provides fuel to the injector tube 20, 161.

The space 34 between the angled tube 22, 158 and the injector tube 20, 161 is open to a space 38 between the inner recuperator wall 159 and the cylindrical outer liner 144 of the combustor housing 139. The space 38 may be the common combustion air source 38 previously noted with regard to FIG. 1. Heated compressed air from the recuperator 123 is supplied to the space 38 between the inner recuperator wall 159 and the cylindrical outer liner 144 of the combustor housing 139 and is thus available to the annular space 34 interior of the angled tube 22, 158.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art which changes are encompassed within the scope and spirit of the present invention as defined by the appended claims.

What is claimed is:

1. A fuel injector apparatus, comprising:

an elongated tubular injector body having an inlet end and an outlet end, the body having an inner wall defining an interior, the inner wall having one or more near-wall layer air injection ports defined therein;

a guide vane separating a final mixing chamber adjacent the outlet end from one or more pre-mixing chambers upstream of the guide vane, the guide vane including:

a non-perforated lateral vane portion attached to the inner wall upstream of the one or more near-wall layer air injection ports and extending laterally inward; and an axial vane portion extending downstream from the lateral vane portion and defining an axially central flow passage for all fuel-air mixture from the one or more pre-mixing chambers, the axial vane portion and the inner wall defining an injection annulus downstream of the lateral vane portion, the one or more near-wall layer air injection ports opening into the injection annulus; and a fuel distributor disposed in the interior upstream of the guide vane, the fuel distributor including a lateral distributor portion attached to the inner wall and extending laterally inward, an axially projecting distributor portion projecting downstream from the lateral distributor portion, and a distributor end wall having a plurality of distribution openings, such that fuel and air mixture exits the distributor end wall through the distribution openings in an axially central core flow stream aligned with the axially central flow passage of the guide vane, the distributor end wall being tapered in the downstream direction to a central tip.

2. The apparatus of claim 1, wherein:

the guide vane is configured such that fuel and air mixture exits the outlet end in an axially central core flow stream surrounded by an annular near-wall layer flow stream relatively free of fuel so that near-wall layer flashback is inhibited.

3. The apparatus of claim 2, wherein the guide vane is configured such that the axially central core flow stream has a sufficiently high core flow velocity such that a core flashback mechanism is prevented from occurring.

4. The apparatus of claim 1, wherein:

the inner wall of the injector body has one or more intermediate mix air injection ports defined therein between the fuel distributor and the guide vane, for providing additional mix air to the fuel and air mixture exiting the distributor end wall, and for establishing an initial near-wall layer air flow along an inside wall of the axial vane portion of the guide vane.

5. The apparatus of claim 1, wherein:

the one or more pre-mixing chambers include a preliminary pre-mixing chamber between the inlet end and the fuel distributor, and an intermediate pre-mixing chamber between the fuel distributor and the guide vane.

6. The apparatus of claim 1, wherein:

the one or more pre-mixing chambers includes a primary pre-mixing chamber adjacent the inlet end of the injector body; and the inner wall has one or more primary air injection ports defined therein and communicated with the primary pre-mixing chamber.

7. The apparatus of claim 6, further comprising:

one or more gaseous fuel inlets communicated with the primary pre-mixing chamber.

8. The apparatus of claim 6, further comprising:

one or more liquid fuel nozzles communicated with the primary pre-mixing chamber.

9. The apparatus of claim 6, further comprising:

one or more gaseous fuel inlets communicated with the primary pre-mixing chamber; and one or more liquid fuel nozzles communicated with the primary pre-mixing chamber, such that the apparatus has the capability to operate on gaseous and liquid fuels simultaneously.

10. The apparatus of claim 1, wherein:

the axial vane portion terminates in a sharp edged guide vane outlet configured to atomize any remaining liquid fuel droplets.

11. The apparatus of claim 1, wherein:

the outlet end of the injector body converges to a reduced diameter outlet opening.

12. The apparatus of claim 1, wherein:

the outlet end of the injector body has a venturi shape.

13. The apparatus of claim 1, wherein:

the outlet end of the injector body diverges to an enlarged diameter outlet opening.

14. The apparatus of claim 1, further comprising:

an annular outer wall concentrically disposed about the injector body and defining an annular air supply passage between the outer wall and the injector body, the one or more near-wall layer injection ports being communicated with the annular air supply passage.

15. The apparatus of claim 1, wherein:

the inner wall of the injector body has one or more intermediate mix air injection ports defined therein between the fuel distributor and the guide vane, for providing additional mix air to the fuel and air mixture exiting the tapered distributor end wall, at least some of the intermediate mix air injection ports being laterally aligned with the distribution openings in the tapered distributor end wall so as to aid in mixing the fuel and air mixture exiting the tapered distributor end wall.

* * * * *